US005782647A

United States Patent [19]

Okura et al.

[11] Patent Number: 5,782,647

[45] Date of Patent: Jul. 21, 1998

[54] ELECTRICAL CONNECTOR WITH INTERNAL RESILIENT MEMBER

[75] Inventors: Yoshio Okura; Mitsuhiro Fujitani, both of Yokkaichi, Japan

[73] Assignee: Sumitomo Wiring Systems, Ltd., Japan

[21] Appl. No.: 747,554

[22] Filed: Nov. 12, 1996

[30] Foreign Application Priority Data

Nov. 14, 1995 [JP] Japan ..... 7-321074

[51] Int. Cl.[6] ..... H01R 13/627

[52] U.S. Cl. ..... 439/358; 439/357

[58] Field of Search ..... 439/350, 352, 439/354, 357, 358

[56] References Cited

U.S. PATENT DOCUMENTS 4,721,358 1/1988 Faber et al. ..... 439/350 X 4,941,838 7/1990 Zinn ..... 439/358 X 5,310,358 5/1994 Johnson et al. ..... 439/358

5,376,017 12/1994 Taniuchi et al. .

FOREIGN PATENT DOCUMENTS 7211392 8/1995 Japan .

*Primary Examiner*—Khiem Nguyen

*Attorney, Agent, or Firm*—Jordan B. Bierman; Bierman, Muserlian and Lucas

[57] ABSTRACT

A pivoting member attached to a female housing, which is capable of receiving a complementary male housing. A resilient elastic member, preferably U-shaped, is disposed between an operating portion toward the rear of pivoting member and the female housing. The bend of the U-shape is positioned toward the pivot. The resilient member 50 is hidden behind the pivoting member and is located within the housing so that it does not get caught by parts of other connectors shipped with it in a single container.

6 Claims, 6 Drawing Sheets

ELECTRICAL CONNECTOR WITH INTERNAL RESILIENT MEMBER

This Application claims the benefit of the priority of Japanese Application 7-321074, filed Nov. 14, 1995.

The present Invention relates to an electrical connector, in particular, one which prevents incomplete fitting and minimizes the risk of entanglement during packing and shipping.

BACKGROUND OF THE INVENTION

As described in Japanese OPI 7-211392, and as shown herein in FIGS. 7 and 8, connector 1 comprises male housing 2 and female housing 3 which are adapted to fit together, and pivoting member 4 comprising cam 4*a* attached to male housing 2 and sliding against female housing 3. The side toward the interface between the housings is referred to as the front.

Pivoting member 4 is formed as a square, C-shaped hood. Pivot holes 4*b*, disposed on the rear of member 4, are attached to supporting shafts 2*a* which project from approximately the center of the two sides of male housing 2. Resilient member 5 serves to press pivoting member 4 against the upper surface of the front of male housing 2. Referring to FIG. 8, elastic member 5 is substantially U-shaped and is formed by bending a plate spring to form free ends 5*a*, 5*b*. The open side of the U is turned toward the front. Free end 5*a* is fixed to male housing 2, and the other free end 5*b* presses against pivoting member 4 from the outside.

Referring to FIG. 9, when connector 1 is fitted, female housing 3 slides against cam 4*a*, pressing it upward. This causes member 4 to pivot, flexing elastic member 5. As can be seen in FIG. 10, when the fitting operation is complete, the restoration of resilient member 5 causes cam 4*a* to engage with and lock female housing 3. In the prior art connector 1 described above, resilient member 5 is exposed to the exterior. If pluralities of connector units assembled with harnesses are packed in bags and shipped, the exposed resilient members 5 can get caught on each other, thus making handling difficult. Also, in unlocking connector 1, it is necessary to lift up the tip of pivoting member 4. This operation requires both hands, making the connector difficult to use.

SUMMARY OF THE INVENTION

The object of the present Invention is to overcome the drawbacks of the prior art described above and, in particular, to provide a connector that is easy to handle and whose resilient member does not undesirably engage parts of other connectors.

In the present Invention, a pivoting member urged by a resilient member is disposed on a first of two mutually fittable housings. A second housing is fitted to the front of the first housing and the two housings are brought to a fitting position by rotating the pivoting member so that it overcomes the force of the resilient member. The pivoting member comprises a bearing point disposed further toward the rear than the pivot, and the resilient member is disposed between the bearing point and the first housing so that it urges the bearing point upward.

Preferably, the resilient member is in a U-shape, and the bend of the U-shape is located on the pivot side. The two parallel legs of the U are pressed against the bearing point and the first housing so that the bearing point is pushed outward. This construction permits the resilient member to have a simple structure and also allows the pivoting member to be located in the connector housing without wasting space, thus preventing the resilient member from getting caught by parts of other devices.

Also, in the configuration described above, when the second housing is fitted to the front of the first housing, the second housing causes the pivoting member to pivot in opposition to the elastic force exerted by the resilient member. If, during this fitting process, the insertion of the second housing is stopped before the maximum elastic force is overcome, the connectors would be in a partially fitted state, and the elastic force of the resilient member would reject the second housing. Conversely, if insertion of the second housing is stopped after the maximum elastic force is overcome, the housing would be drawn in by the elastic force of the resilient member, thus bringing the connector to a complete fit. In either case, an incomplete fit is avoided.

To disengage the housing, a portion of the resilient member adjacent the bearing point is pressed inwardly from outside. This causes the pivoting member to move against the elastic force of the resilient member. Thus, the housings can be disengaged without requiring the use of both hands, as in conventional devices.

BRIEF DESCRIPTION OF THE DRAWINGS

In the accompanying drawings, constituting a part hereof, and in which like reference characters indicate like parts.

DETAILED DESCRIPTION OF THE INVENTION

Figure 1:
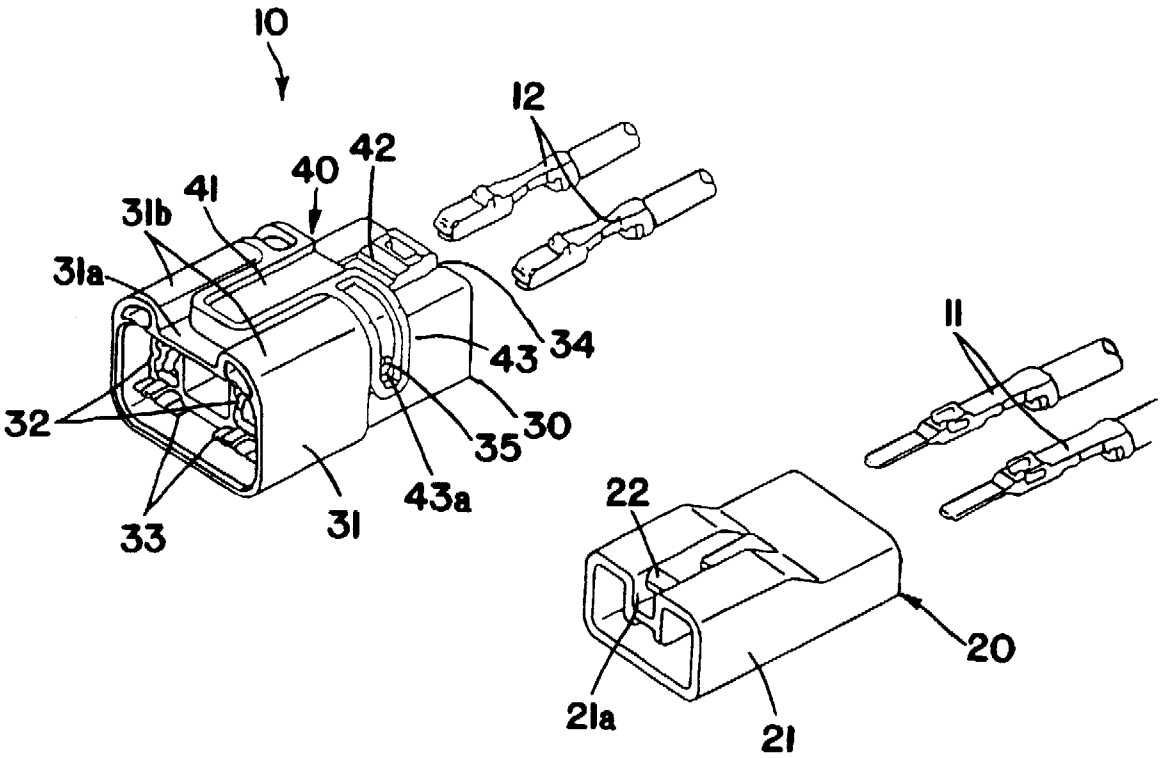
FIG. 1 is a perspective view of the connector of the present Invention.

Connector 10 comprises a male housing 20 and a female housing 30, which are adapted to fit together. Member 40 is pivotally attached to female housing 30.

Male housing 20 can hold two male terminals 11. Toward the front is male hood 21 which fits into female housing 30. A flexible shorting piece 13 is cantilevered inside male housing 20. The free end thereof is in contact with male terminal 11 so that the two are shorted. Shorted piece 13 can be flexed by disengagement piece 33 so that it no longer contacts male terminal 11; in other words, the degree of insertion of the housings in connector 10 can be determined by whether male terminals 11 are continuous.

Female housing 30 holds female terminal 12, which is adapted to electrically connect with male terminal 11. Cylindrical female hood 31 having a raised portion toward the front is disposed on female housing 30. Body 32 projects from the far inside wall of female hood 31. The gap between female hood 31 and body 32 allows male hood 21 to be inserted. Disengagement piece 33 projects from the front surface of body 32; when fitting is complete, it deflects shorting piece 13 so that the short between male terminals 11 is disengaged.

Pivoting member 40 carries a raised portion corresponding to the raised portion on the upper surface wall of female housing 30. Arm 41 formed by the front side of the raised portion comes into contact with upper surface 31*a* of female hood 31. operating portion 42 enters rotation groove 34 formed toward the rear of female housing 30. Pivoting member 40 comprises support 43 which extends toward the two sides at roughly the center point of member 40 and bends downward. Rotation holes 43*a*, on the ends of support 43, engage shafts 35, which project from the sides of female housing 30. When member 40 is attached to female housing 30, arm 41 is disposed between protecting walls 31*b*, at the side edges of upper surface 31*a*, and operating portion 42 is in rotation groove 34. Neither operating portion 42 nor arm 41 projects externally. Furthermore, support 43 is located at the raised portion so that the part of it which does project outward is kept to a minimum.

Figure 2:
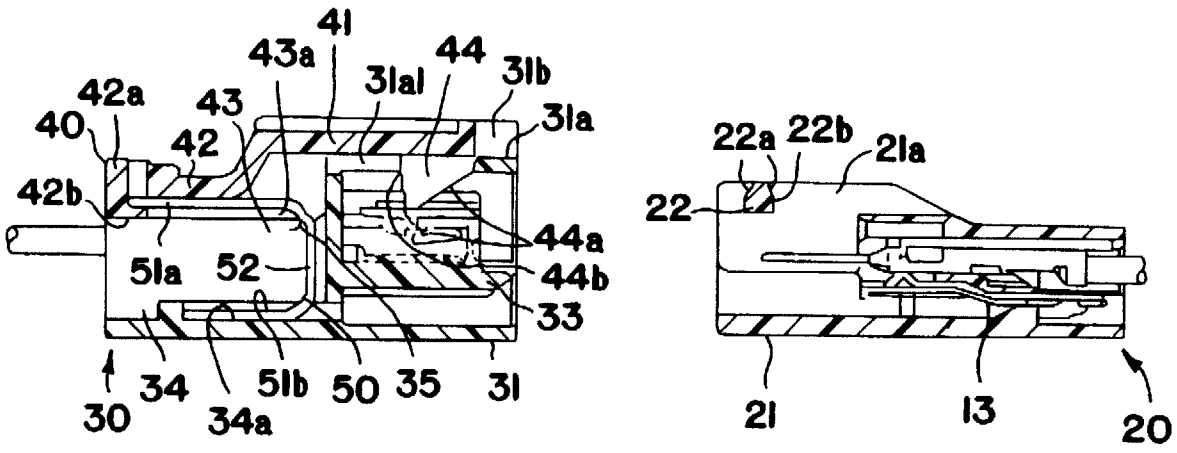
FIG. 2 is a cross-section of the connector of FIG. 1 in the unfitted state.

As can be seen in FIG. 2, cam 44 is on the surface of arm 41 which comes into contact with female hood 31. Cam 44 extends through hole 31*a*1 and thus projects into female hood 31. Incline 44*a* slopes toward the front and the rear and slides against male housing 20 when the housing is inserted into female hood 31. Groove 21*a* is on the part of male hood 21 facing cam 44 so that there is no obstruction thereof. Actuator 22 is also disposed on male hood 21 so as to prevent obstruction. Incline 22*a*, raised at the center, is on the upper surface of actuator 22 to slide against incline 44*a*.

When connector 10 is assembled, the sloped surfaces toward the fronts of incline 44*a* and incline 22*a* slide against each other and arm 41 is lifted upward. When the apex is passed, the inclines toward the rear slide against each other. Thus fitting is completed by pushing arm 41 downward. Incline 44*a* has a flare so that it can slide against sliding incline 22*a* even if cam 44 is inside female hood 31. Incline 44*a* is shorter toward the rear and has perpendicular surface 44*b*. When cam 44 goes past actuator 22, perpendicular surface 44*b* comes into contact with rear end 22*b* thereof so that the connector is locked.

Resilient member 50 is formed by bending a spring steel plate into a U-shape. Resilient member 50 comprises bend 52 connecting two free ends 51*a* and 51*b*. Free end 51*a* is about the same length as operating portion 42. Bend 52 is positioned toward the front and free end 51*a* is disposed against the lower surface of operating portion 42. Free end 51*b* is slightly shorter than end 51a, and is in contact with bottom surface 34*a* of rotation groove 34. The end of free end 51*a* is fixed by engagement piece 42*b* on the rear of operating portion 42.

The gap between free ends 51*a* and 51*b* is greater than the gap between bottom surface 34*a* and operating portion 42. This provides a preloading force applied to arm 41 and presses it against female hood 31, thereby avoiding looseness.

Figure 3:
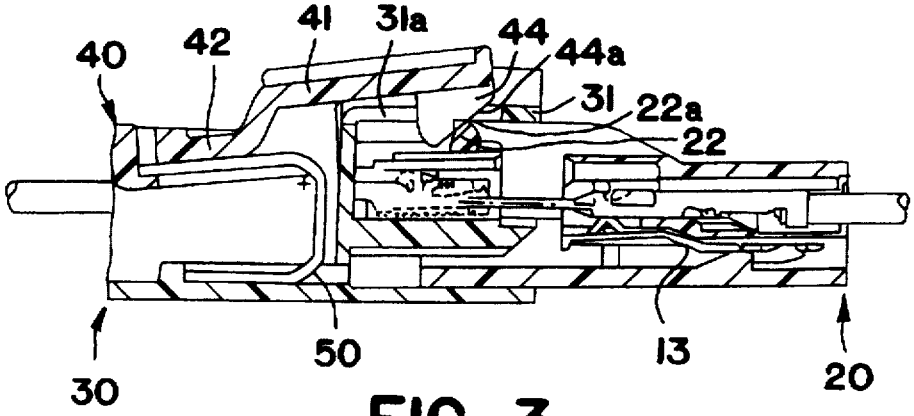
FIG. 3 is a cross-section of the connector at the initial stage of fitting.

As shown in FIG. 2, pivoting member 40 includes cam 44 projecting inside female hood 31 of female housing 30. Cam 44 is in contact with female hood 31 due to the pressure of resilient member 50. The opening of male hood 21 is oriented to face female hood 31 and male hood 21 is inserted into female hood 31. This causes the front incline of incline 22*a* to contact the front incline of incline 44*a*. Referring to FIG. 3, when male housing 20 is pressed in further, the sliding of the front incline causes cam 44 to be lifted. This causes operating portion 42 to pivot downward and compresses resilient member 50. A strong elastic force is created which causes male housing 20 to be pushed out. Thus, if insertion is halted at this point, male housing 20 is pushed out of female housing 30, thus preventing an incomplete fit.

Figure 4:
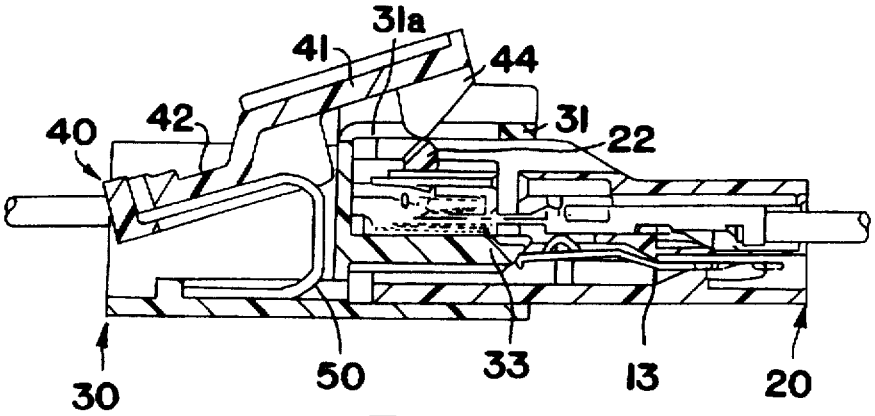
FIG. 4 is a cross-section of the connector at a critical point in the fitting process, i.e. between the initial and final stages.
Figure 5:
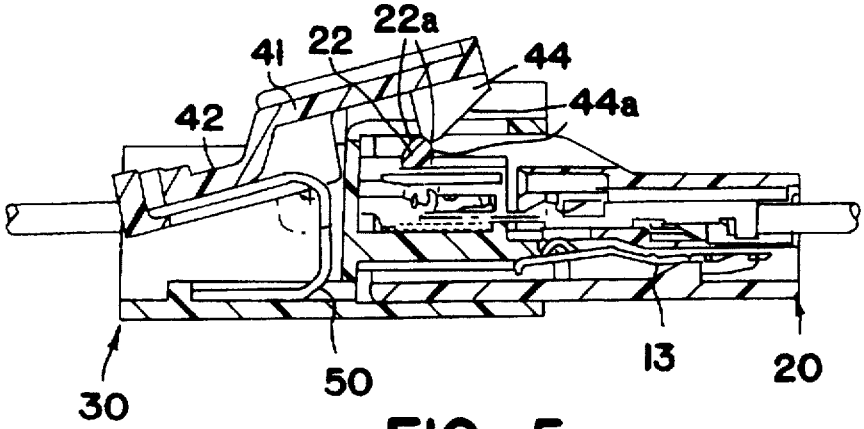
FIG. 5 is a cross-section of the connector near the final stage.

In FIGS. 4 and 5, by pressing male housing 20 further into female housing 30 and against the elastic force, the apex of incline 44*a* goes past the apex of sliding incline 22*a*, and the rear inclines slide against each other. Thus, if male housing 20 were released at this point, the elastic force from resilient member 50 would draw male housing 20 into female housing 30 so that an incomplete fit is avoided.

Figure 6:
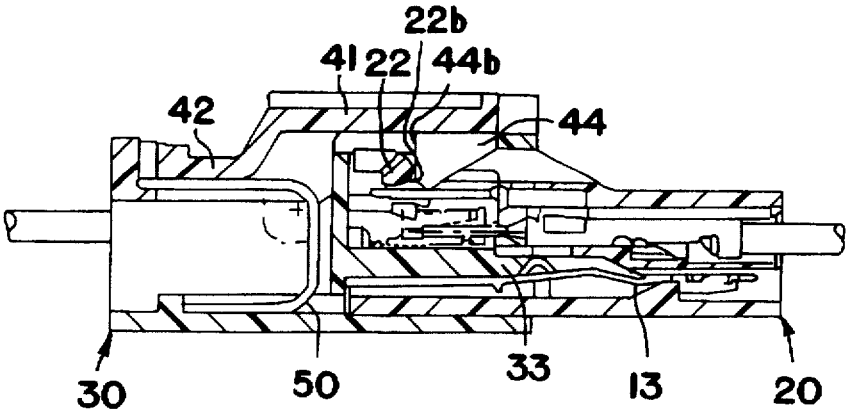
FIG. 6 is a cross-section of the connector when fitting is complete.
Figure 7:
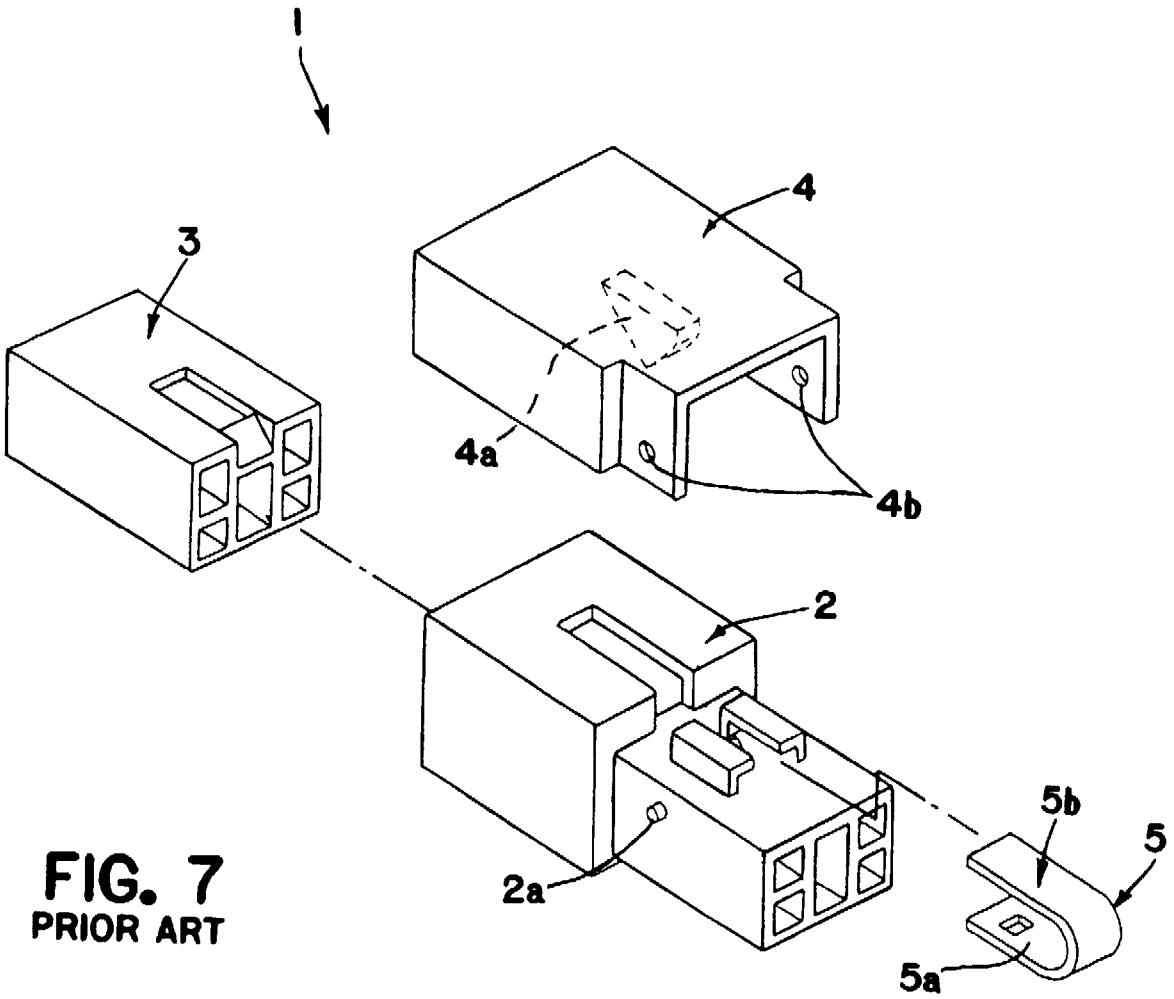
FIG. 7 PRIOR ART
FIG. 7 is a perspective of a prior art connector.
Figure 8:
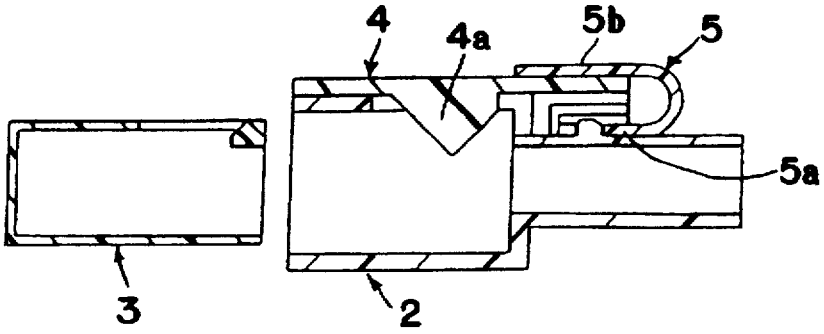
FIG. 8 PRIOR ART
FIG. 8 is a cross-section of the prior art connector of FIG. 7 before fitting.
Figure 9:
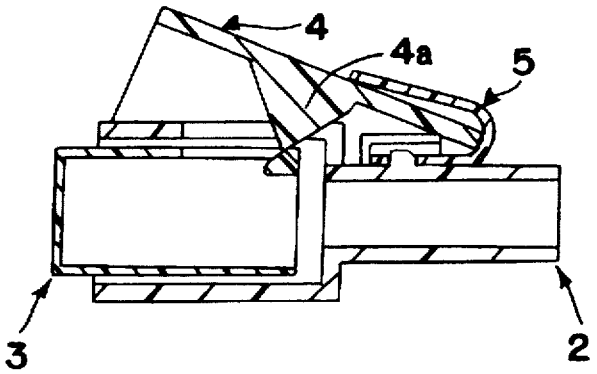
FIG. 9 PRIOR ART
FIG. 9 is a cross-section of the prior art connector partially fitted.
Figure 10:
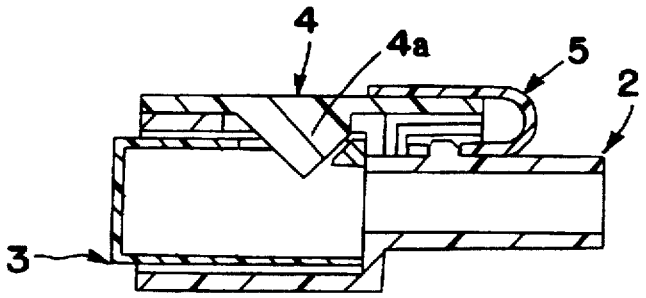
FIG. 10 PRIOR ART
FIG. 10 is a cross-section showing the prior art connector when fitting is complete.

Male housing 20 is inserted all the way into female housing 30 while the rear inclines of incline 44*a* and incline 22*a* slide against each other. In FIG. 6, cam 44 goes past actuator 22 and the elastic force of resilient member 50 causes it to return to its original position, so that cam 44 projects into female hood 31 again. At this point, if a pulling force is applied to male housing 20, it could not be withdrawn from female housing 30, since perpendicular surface 44*b* would be in contact with rear surface 22*b* of actuator 22, thus locking the housing together. When the housings are to be separated from each other, they can be disengaged by pressing operating portion 42 inward, thereby moving cam shaped projection 44 out of female hood 31. This allows male housing 20 to be easily removed.

Resilient member 50, which prevents incomplete assembly, does not project outward since it is attached between pivoting member 40 and female housing 30. Also, when no fitting operation is being performed, member 40 does not project outward and is entirely located in the prescribed space in female housing 30. Thus, this configuration avoids the problem of the prior art wherein handling is made difficult by the fact that the projecting portions of resilient members and pivoting members can catch each other when a plurality of connectors, especially if harnesses are attached, are being shipped in a single container.

Although only a certain number of embodiments have been expressly described, the scope of the present Invention is not restricted thereto.

(1) In the embodiment described above, the male and female housings each have a hood. However, hoods need not be used as long as the connectors can hold the terminals so that they can be in electrical contact with each other. By using hoods, however, the terminals are protected from external forces. Also, if hoods are used in both housings, as in the embodiment described above, looseness therebetween can be minimized.

(2) In the embodiment described above, the pivoting member is an arm with a raised portion. However, any shape can be used, as long as the member can be pivotally attached to one of the housings. For example, it would be possible to have the member formed as a hood toward the front of the pivot and formed as a lever toward the rear. Also, in the embodiment described above, cam 44 projects from arm 41 so that the mechanism pivots member 40. However, any kind of mechanism which causes movement of the member depending on the fit can be used. For example, the cam can be on the female housing.

(3) In the embodiment described above, the resilient member is U-shaped and disposed between operating portion 42 and female housing 30. However, the resilient member need not be in the U-shape, but rather can be any shape which allows it to be attached between the operating portion toward the rear of the rotating member and the housing without projecting outward. For example, a compressed coil spring or the like can be used. By using a U-shape and having the bend therein positioned toward the pivot, the pivoting member can be compactly held in the integral space designed therefor.

These and other changes may be made in the Invention without departing from the scope thereof. It is not to be limited except by the character of the claims appended hereto.

What we claim is:

1. An electrical connector comprising a male housing and a female housing, said male housing adapted for insertion along a path into said female housing in an insertion direction, whereby at least one terminal in said male housing is brought into electrical contact with a corresponding terminal in said female housing, a pivoting arm mounted on one of said female housing and said male housing, a cam on said arm, said arm adapted to pivot about a pivot point and having a locking position, wherein said cam is in said path, and an open position, wherein said cam is not in said path, an actuating member on another of said male housing and said female housing, said actuating member adapted to contact said cam at a surface thereof as said male housing is inserted into said female housing, a resilient member disposed entirely within said one housing and bearing against said arm at a bearing point, said pivot point being between said bearing point and said cam, said resilient member urging said arm toward said locking position, said resilient member having a bent portion and two legs, one of said legs bearing against said arm at said bearing point and another of said legs bearing against an internal surface of a wall of said one housing.

2. The electrical connector of claim 1 wherein said bent portion is concave toward said pivot point.

3. The electrical connector of claim 1 wherein said cam comprises an inclined surface angled inwardly in said insertion direction, a reverse incline angled outwardly in said insertion direction, and an apex therebetween.

4. The electrical connector of claim 3 wherein a rear face of said cam in said insertion direction is substantially perpendicular to said direction.

5. An electrical connector comprising a male housing and a female housing, said male housing adapted for insertion along a path into said female housing in an insertion direction, whereby at least one terminal in said male housing is brought into electrical contact with a corresponding terminal in said female housing, a pivoting arm mounted on one of said female housing and said male housing, a cam on said arm, said arm adapted to pivot about a pivot point and having a locking position, wherein said cam is in said path, and an open position, wherein said cam is not in said path, an actuating member on another of said male housing and said female housing, said actuating member adapted to contact said cam at a surface thereof as said male housing is inserted into said female housing, a resilient member disposed entirely within said one housing and bearing against said arm at a bearing point, said pivot point being between said bearing point and said cam, said resilient member urging said arm toward said locking position, a pair of projecting walls with a space therebetween on an external surface of said other of said male housing and said female housing, said pivoting arm being located in said space when said male housing is secured in said female housing.

6. The electrical connector of claim 5 wherein an outer surface of said pivoting arm is substantially flush with said pair of projecting walls.

* * * * *